US006234857B1

(12) United States Patent
Suellentrop

(10) Patent No.: US 6,234,857 B1
(45) Date of Patent: May 22, 2001

(54) PET RECREATION FLOTATION DEVICE

(76) Inventor: Kevin M. Suellentrop, 4368 Meadowgreen Estates Dr., St. Louis, MO (US) 63129

( * ) Notice: Subject to any disclaimer, the term of this patent is extended or adjusted under 35 U.S.C. 154(b) by 0 days.

(21) Appl. No.: 09/564,965

(22) Filed: May 4, 2000

(51) Int. Cl.[7] ..... B63C 9/08

(52) U.S. Cl. ..... 441/129; 441/131; 114/346

(58) Field of Search ..... 441/35, 40, 43, 441/129–132; 114/345, 346, 357; 472/128, 129

(56) References Cited

U.S. PATENT DOCUMENTS

| | | | | |
|---|---|---|---|---|
| D. 224,127 | | 7/1972 | Frank . | |
| D. 227,935 | | 7/1973 | Keller . | |
| D. 330,139 | | 10/1992 | Bloom . | |
| D. 401,982 | | 12/1998 | Peterson . | |
| 1,960,474 | | 5/1934 | Browne . | |
| 3,135,978 | | 6/1964 | Grasmoen . | |
| 3,225,367 | * | 12/1965 | Gavlek | 114/346 |
| 3,363,272 | * | 1/1968 | Channon | 441/129 |
| 3,594,836 | * | 7/1971 | Robertson | 441/129 |
| 4,409,921 | | 10/1983 | Carroll et al. . | |
| 4,696,251 | * | 9/1987 | Spieldiener et al. | 114/346 |
| 4,708,676 | | 11/1987 | Lin . | |
| 4,799,910 | | 1/1989 | Kellough . | |
| 5,320,568 | | 6/1994 | Koerkel, Jr. . | |
| 5,458,517 | | 10/1995 | Ellis . | |
| 5,479,663 | | 1/1996 | Boyd . | |
| 5,503,099 | | 4/1996 | Peterson . | |
| 5,514,016 | | 5/1996 | Larson . | |
| 5,514,020 | | 5/1996 | Gainforth . | |
| 5,515,560 | | 5/1996 | Strobel . | |
| 5,628,275 | | 5/1997 | Casey . | |
| 5,628,658 | | 5/1997 | Clifford . | |
| 5,662,063 | | 9/1997 | Seijas . | |
| 5,810,632 | * | 9/1998 | Huston, III | 441/129 |
| 5,951,348 | | 9/1999 | Liong et al. . | |

FOREIGN PATENT DOCUMENTS

| | | | |
|---|---|---|---|
| 2654699 | 5/1991 | (FR) | 441/67 |

* cited by examiner

*Primary Examiner*—Ed Swinehart
(74) *Attorney, Agent, or Firm*—Armstrong Teasdale LLP

(57) ABSTRACT

A non-inflatable flotation device that includes a substantially flat non-inflatable buoyant base portion, and a non-inflatable buoyant rim wall extending from the base portion. The rim wall extends at least partially around the periphery of the base portion. A tow line connection lug extends from an edge of the base portion, and in one embodiment a tow line is connected to the connection lug. The non-inflatable base portion and the non-inflatable rim wall are formed from a resilient foam having a density less than water. The resilient foam is formed from polyurethane resins or polystyrene beads. A protective layer covers all outer surfaces of the flotation device. The protective layer is formed from a protective coating applied to the outer surfaces.

18 Claims, 2 Drawing Sheets

PET RECREATION FLOTATION DEVICE

BACKGROUND OF THE INVENTION

This invention relates generally to flotation devices and more particularly to a non-inflatable flotation device for a pet animal.

Many pet owners enjoy bringing their pets along while enjoying recreational water activities such as swimming at the beach or pool. Most pets tire after swimming for a period of time or will not swim for extended periods of time. It would be desirable to have a flotation device on which the pet can float and rest while the owner swims or floats on the water.

Known recreational flotation devices include, for example, inflatable and non-inflatable floating chairs, inflatable rafts, inner tubes, and large substantially flat structures such as, for example, surfboards and boogie boards. These known devices are not suitable for pets, particularly the inflatable devices. Pets, such as dogs and cats have nails and claws on their paws that can puncture a wall of an inflatable device causing the device to leak air and sink. Additionally, pets can easily slip off flat flotation devices such as surfboards and boogie boards.

It would be desirable to provide a flotation device that can support a pet animal which will prevent the pet from slipping off the device. Additionally, it would be desirable to provide a flotation device that is not affected by scratches and punctures caused by the pet animal's nails or claws. Further, it would be desirable to provide a flotation device that is easily manufactured.

BRIEF SUMMARY OF THE INVENTION

These and other objects may be attained by a non-inflatable flotation device sized to support a pet animal. The non-inflatable flotation device includes a substantially flat non-inflatable buoyant base portion, and a non-inflatable buoyant rim wall extending from the base portion. The rim wall extends around the periphery of the base portion. A tow line connection lug extends from an edge of the base portion, and in one embodiment a tow line is connected to the connection lug.

The non-inflatable base portion and the non-inflatable rim wall are formed from a resilient foam having a density less than water. The resilient foam is made from polyurethane resins or polystyrene beads. The resilient foam may be rigid, semi rigid, or flexible. A protective layer covers all outer surfaces of the flotation device. The protective layer is formed from a protective coating applied to the outer surfaces by any suitable method, for example spraying or dipping.

The above described non-inflatable flotation device can support a pet animal and includes a rim wall which prevents the pet from slipping off the flotation device. Additionally, because the above described flotation device is non-inflatable, it is not affected by scratches and punctures caused by the pet animal's nails or claws. Further, the above described flotation device is easily manufactured by the use of known foam molding techniques and known coatings application techniques for example spraying and dipping.

DETAILED DESCRIPTION OF THE INVENTION

Figure 1:
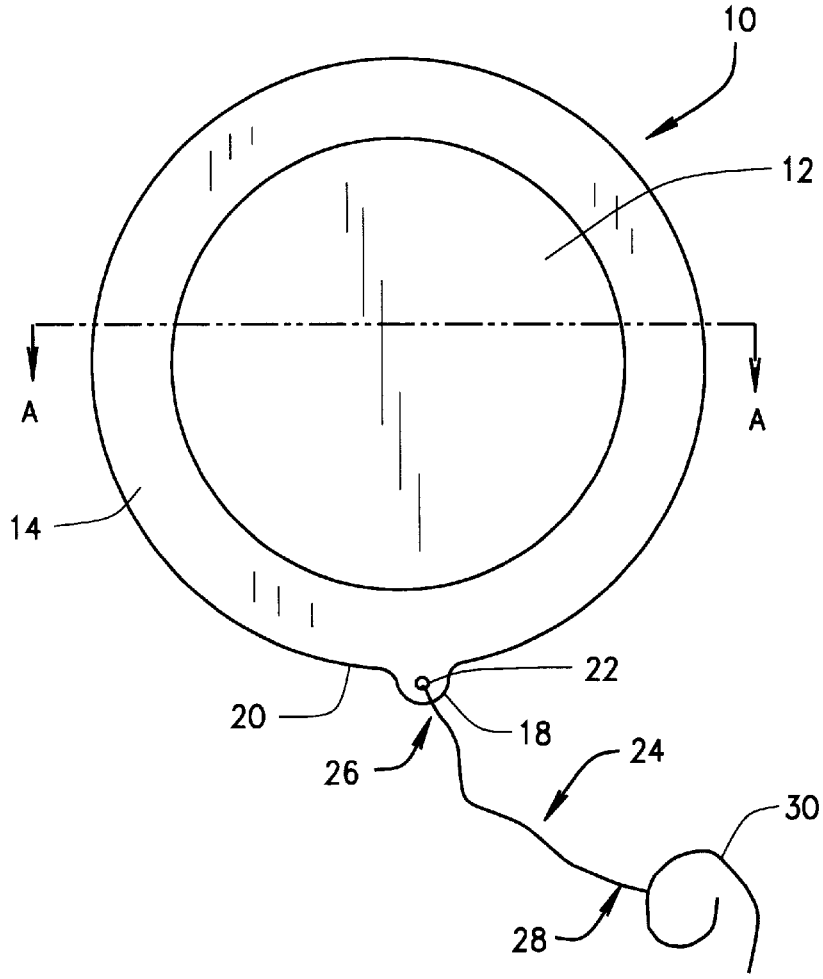
FIG. 1 is top view of a pet flotation device in accordance with an embodiment of the present invention.
Figure 2:
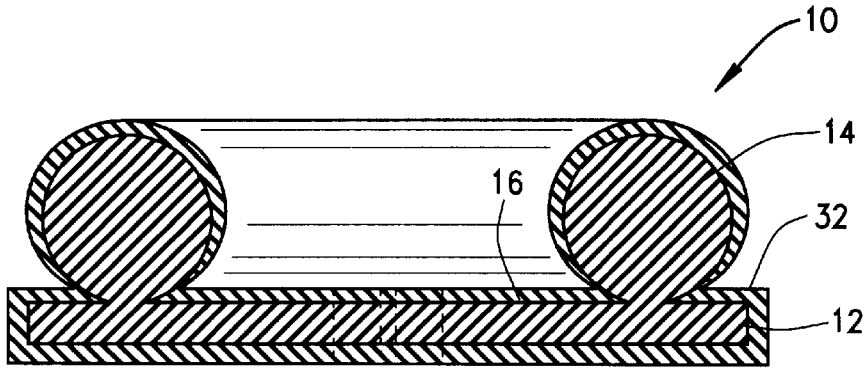
FIG. 2 is a cross-sectional view through line A—A of the pet flotation device shown in FIG. 1.

FIG. 1 is top view of a pet flotation device 10 in accordance with an embodiment of the present invention, and FIG. 2 is a cross-sectional view of pet flotation device 10 through line A—A. Referring to FIGS. 1 and 2, flotation device 10 is non-inflatable and includes a substantially flat non-inflatable buoyant base portion 12, and a non-inflatable buoyant rim wall 14 extending from an upper surface 16 of base portion 12. Rim wall 14 extends around the periphery of base portion 12. In an alternative embodiment, rim wall 14 extends at least partially around the periphery of base portion 12. Rim wall 14 has a tubular shape. However, rim wall 14 is not restricted to a tubular shape and in alternative embodiments may have any suitable shape. A tow line connection lug 18 extends from an edge 20 of base portion 12. Connecting lug 18 includes an opening 22 extending therethrough and sized to receive a tow line 24. A first end 26 of tow line 24 is attached to connecting lug 18. A second end 28 of tow 24 is attached to a sleeve 30. Sleeve 30 is sized for attaching to a person's arm of ankle. In one embodiment, a VELCRO® fastener (not shown) is used to attach sleeve 30 to a person's arm or leg. Of course, any suitable fastener, such as, for example, buttons, snaps, or zippers, may be used. In other embodiments, second end 26 of tow line 24 is attached to a handle instead of sleeve 30. Examples of suitable handles include, but are not limited to, a T-shaped handle and a D-shaped handle.

Figure 3:
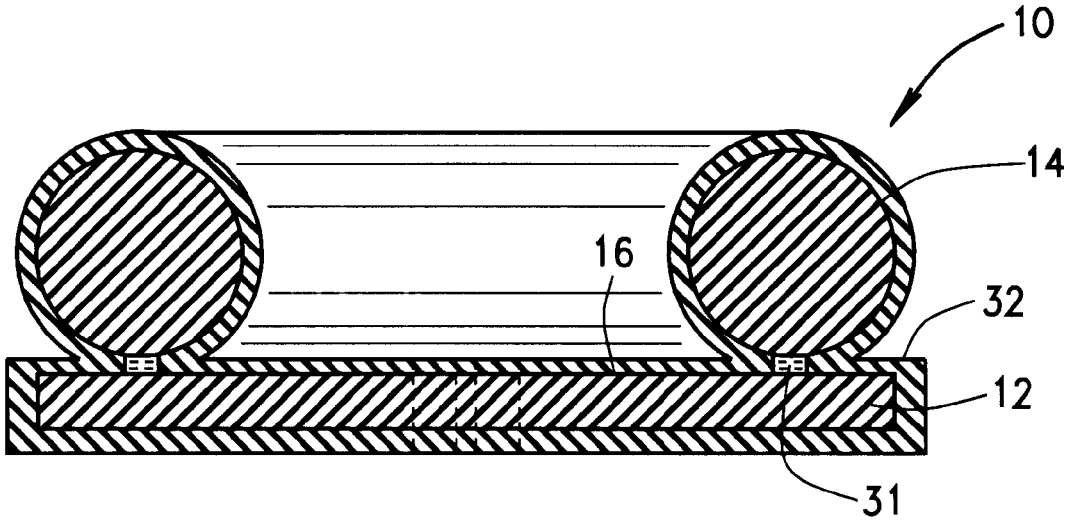
FIG. 3 is a cross-sectional view of a pet flotation device in accordance with another embodiment of the present invention.

Non-inflatable base portion 12 and non-inflatable rim wall 14 are formed from a resilient foam having a density less than water. Base portion 12 and rim wall 14 are easily formed using known molding methods. Flotation device 10, in one embodiment, is formed by molding base portion 12 and rim wall 14 as one piece. In other embodiments, base portion 12 and rim wall 14 are molded as separate pieces and arc coupled together to form flotation device 10 using known attachment techniques such as, for example adhesives, heat welding, or fasteners. FIG. 3 shows base portion 12 and rim wall 14 coupled together by an adhesive 31. Any known resilient foam having a density less than water can be used to form base portion 12 and rim wall 14. In an exemplary embodiment, the resilient foam is made from polyurethane resins or polystyrene beads. The resilient foam may be rigid, semi rigid, or flexible. In one embodiment, after molding, base portion 12 exhibits more rigidity than rim wall 14.

A protective layer 32 covers all outer surfaces of flotation device 10. Protective layer is formed from a protective coating applied to the outer surfaces of flotation device 10 by any suitable method, for example spraying or dipping. Suitable protective coatings include, but are not limited to, urethane coatings and vinyl coatings. In one exemplary embodiment, the protective coating is a polyvinyl chloride (PVC) plastisol coating. The thickness of the protective coating layer is dependent on the type of coating used and the amount of protection from pet animal claws and nails that is desired. Typically, the thickness of the protective coating layer is between about 0.5 mils to about 25.0 mils, but the thickness could be higher for added protection. In one exemplary embodiment the thickness is between about 2.0 mils to about 15 mils.

FIG. 1 shows flotation device 10 having a circular shape. However, flotation device 10 can be any shape. For example, in one exemplary embodiment, flotation device 10 has the shape of a polygon having at least three sides. In other exemplary embodiments, flotation device has the shape of a conic section, for example a circle, an ellipse, a parabola, or a hyperbola. Of course any other free form shape is suitable for flotation device 10, for example, the shape of a dog or a cat.

Flotation device 10 is sized to hold and support a pet animal on water. Larger sized pets sometimes require larger sizes of flotation device 10 and/or a resilient foam having higher buoyancy properties. Flotation device 10 is sized so the pet can sit, lay, or stand on upper surface 16 of base portion 12 inside rim wall 14. Rim wall 14 prevents the pet from sliding off base portion 12.

The above described non-inflatable flotation device 10 can support a pet animal and includes a rim wall 14 which prevents the pet from slipping off the flotation device. Additionally, because the above described flotation device 10 is non-inflatable, it is not affected by scratches and punctures caused by the pet animal's nails or claws. Further, the above described flotation device 10 is easily manufactured by the use of known foam molding techniques.

While the invention has been described in terms of various specific embodiments, those skilled in the art will recognize that the invention can be practiced with modification within the spirit and scope of the claims.

What is claimed is:

1. A non-inflatable pet flotation device configured to support a pet on water, said flotation device comprising:

a substantially flat non-inflatable buoyant base portion having an upper surface and a lower surface;

a non-inflatable buoyant rim wall extending from said upper surface of said base portion, said rim wall extending at least partially around the periphery of said base portion; and a tow line connection lug extending from an edge of said base portion, said connection lug comprising an opening therethrough.

2. A pet flotation device in accordance with claim 1 comprising a plurality of outer surface, said outer surfaces of said flotation device covered with a protective coating.

3. A pet flotation device in accordance with claim 2 wherein said protective coating comprises a urethane coating or a vinyl coating.

4. A pet flotation device in accordance with claim 1 wherein said base portion and said rim wall comprise a resilient foam.

5. A pet flotation device in accordance with claim 4 wherein said resilient foam comprises a foam formed from polyurethane resins or polystyrene beads.

6. A pet flotation device in accordance with claim 4 wherein said base portion and said rim wall are molded as one piece.

7. A pet flotation device in accordance with claim 4 wherein said base portion and said rim wall are molded as separate pieces and coupled together to form said flotation device.

8. A pet flotation device in accordance with claim 7 wherein said base portion and said rim wall are coupled together with adhesive, fasteners, or welding.

9. A pet flotation device in accordance with claim 1 further comprising a tow line coupled to said tow line lug.

10. A pet flotation device in accordance with claim 1 wherein said base portion is more rigid than said rim wall.

11. A non-inflatable flotation device comprising a substantially flat buoyant base member, having an upper surface and a lower surface, a buoyant wall member extending from said upper surface of said base member around at least a portion of the periphery of said base member, and a tow line connection lug extending from an edge of said base member, said connection lug comprising an opening therethrough.

12. A flotation device in accordance with claim 11 wherein said wall member comprises a resilient plastic foam.

13. A flotation device in accordance with claim 12 wherein said base member comprises a resilient plastic foam.

14. A flotation device in accordance with claim 13 wherein said resilient plastic foam comprises a foam formed from polyurethane resins or polystyrene beads.

15. A flotation device in accordance with claim 13 further comprising outer surfaces and a protective layer formed from a protective coating, said protective layer covering said outer surfaces.

16. A flotation device in accordance with claim 15 wherein said protective coating comprises a urethane coating or a vinyl coating.

17. A flotation device in accordance with claim 11 further comprising a tow line coupled to said tow line connection lug member.

18. A flotation device in accordance with claim 11 wherein said base member is more rigid than said wall member.

* * * * *